US007484469B2

(12) United States Patent
Francis

(10) Patent No.: US 7,484,469 B2
(45) Date of Patent: Feb. 3, 2009

(54) BOWSPRITS

(76) Inventor: Rex William Francis, 27 Dunstan Road, Avonsleigh, Victoria (AU) 3782

( * ) Notice: Subject to any disclaimer, the term of this patent is extended or adjusted under 35 U.S.C. 154(b) by 0 days.

(21) Appl. No.: 11/924,123

(22) Filed: Oct. 25, 2007

(65) Prior Publication Data

US 2008/0041289 A1 Feb. 21, 2008

Related U.S. Application Data

(63) Continuation of application No. 10/512,323, filed as application No. PCT/AU03/00490 on Apr. 24, 2003, now Pat. No. 7,299,759.

(30) Foreign Application Priority Data

Apr. 26, 2002 (AU) ..... PS1983

(51) Int. Cl.
*B63B 21/22* (2006.01)

(52) U.S. Cl. ..... 114/210; 114/210

(58) Field of Classification Search ..... 114/210
See application file for complete search history.

(56) References Cited

U.S. PATENT DOCUMENTS

| | | | | |
|---|---|---|---|---|
| 2,742,696 | A | | 5/1956 | George |
| 3,577,951 | A | * | 5/1971 | Smith ..... 114/210 |
| 3,704,680 | A | | 12/1972 | Uher |
| 3,865,065 | A | | 2/1975 | Dennis et al. |
| 4,057,025 | A | | 11/1977 | Piotrowski |
| 4,248,171 | A | | 2/1981 | Barbour |
| D259,240 | S | | 5/1981 | Myron |
| D259,329 | S | | 5/1981 | Barbour |
| 4,362,119 | A | | 12/1982 | Thimander |
| 4,526,123 | A | | 7/1985 | Van Den Haak |
| 4,556,007 | A | | 12/1985 | Awalt, Jr. |
| 4,869,193 | A | | 9/1989 | van den Haak |
| 5,996,524 | A | | 12/1999 | Johnson |

FOREIGN PATENT DOCUMENTS

| | | |
|---|---|---|
| AU | 734 943 B2 | 6/2001 |
| EP | 0 049 544 A2 | 4/1982 |

OTHER PUBLICATIONS

European Search Report for European Patent Application No. 03729723 dated Aug. 29, 2006.
Abstract for Japanese Patent No. 56075287 dated Jun. 22, 1981.
International Search Report for International Patent Application No. PCT/AU03/00490 mailed Jun. 20, 2003.

* cited by examiner

*Primary Examiner*—Jesus D Sotelo
(74) *Attorney, Agent, or Firm*—Andrus, Sceales, Starke & Sawall, LLP

(57) ABSTRACT

A bowsprit or davit assembly is for raising and lowering, and for firmly securing, an anchor. The assembly includes an elongate frame member, of a substantial U-shape in cross-section, adapted to be mounted on a surface (deck of a vessel), the frame member including respective front and rear U-shaped sections, wherein the front section includes respective first and second rotatable rollers for receiving and guiding a rope or cable, the rotatable rollers being displaced from one another in both the vertical and horizontal directions. An elongate member extends between opposed wall members of the front section, at or in the vicinity of the uppermost free edges thereof. Opposed flaps extend laterally normal of the outermost free end of opposed wall members of the front section.

8 Claims, 4 Drawing Sheets

BOWSPRITS

CROSS REFERENCE TO RELATED APPLICATIONS

This application is a continuation of U.S. patent application Ser. No. 10/512,323, filed Oct. 22, 2004, now U.S. Pat. No. 7,299,759 which application is the U.S. national stage application of International Application PCT/AU03/00490, filed Apr. 24, 2003. The International Application claims priority of Australian Patent Application PS 1983, filed Apr. 26, 2002.

FIELD OF THE INVENTION

The present invention relates, in general terms, to improvements in bowsprits or anchor davits, being assemblies or apparatus for use in the raising, lowering and securing (when not in use), of anchors.

THE PRIOR ART

The earliest forms of anchors employed with sea-going vessels involved a simple weight, such as for example a heavy rock, tied with a rope, chain or the like. Subsequently, however, anchors were designed which included structures allowing for such anchors to dig into the bottom of the body of water where the vessel was to be moored or anchored. For this purpose, anchors of this general type included one or more flukes, or pointed members which would dig into the ground or footing. In order to orient the flukes so that they would dig into the ground and not merely lie flat on the bottom of the body of water, one or more cross-pieces were attached to the bottom of the anchor crosswise to the fluke(s). In the result an anchor of this general type included the or each fluke, an extended shank to which the anchor cable of the slip or vessel was attached, and a cross-piece to maintain the fluke or flukes in the appropriate orientation to ensure digging into the bottom of the body of water.

Nowadays, anchors have become in some ways more complicated and more sophisticated structures, the aim being to provide improved anchorage regardless of the nature of the bottom of the body of water wherein the relevant vessel is to be moored. One of the problems which has arisen involves the storing of anchors in such a way that they can be deployed quickly and easily, with a minimum of effort and reduced margin for error, regardless of the expertise, or lack of expertise, of the person or persons executing such a task. Another problem has been found to be the tendency, with known bowsprits, for chafing of the anchor rope, usually attached to an anchor via an anchor chain or the lie, due to the abrasive effect of rapid movement thereof during, for example, setting of the associated anchor. Such chafing, if not avoided, may ultimately give rise to severing of the anchor rope, in turn resulting in loss of the anchor, a potentially disastrous consequence for the vessel user(s).

The present invention therefore seeks to overcome the problems and disadvantages associated with the known and presently in use bowsprit arrangements or assemblies, by providing an overall bowsprit which has, to all intents and purposes, no moving parts, is stronger and hence more resistant to the significant loads and stresses likely to be encountered during raising and lowering of an anchor, and wherein the likelihood of jamming of the anchor rope or cable, and even the onset of severing or chafing thereof, is minimised, if not removed altogether.

Accordingly, the present invention seeks to provide an improvement means for raising and lowering of anchors.

In accordance with the present invention there is provided an improved assembly for the raising and lowering of an anchor, said assembly including an elongate frame member including: a first or rear substantially U-shaped section adapted, in use, to be mounted or secured to a deck or the like surface of a vessel, said first section being adapted to receive and releasably retain a main shank of said anchor when said anchor is not deployed or in use; and a second or front U-shaped section, depending longitudinally from said first section and adapted to extend from the deck of the vessel, wherein said second section includes respective primary and secondary rollers or pulley wheels for guiding a rope or cable of said anchor as it is raised and lowered, said rollers or pulley wheels being spaced apart both longitudinally and in the height direction of said second section.

DESCRIPTION OF THE DRAWINGS

In order that the invention may be more clearly understood and put into practical effect there shall now be described in more detail preferred embodiments of a bowsprit or davit assembly in accordance with the invention. The ensuing description is given by way of non-limitative example only and is with reference to the accompanying drawings, wherein.

DESCRIPTION OF PREFERRED EMBODIMENTS

Figure 1:
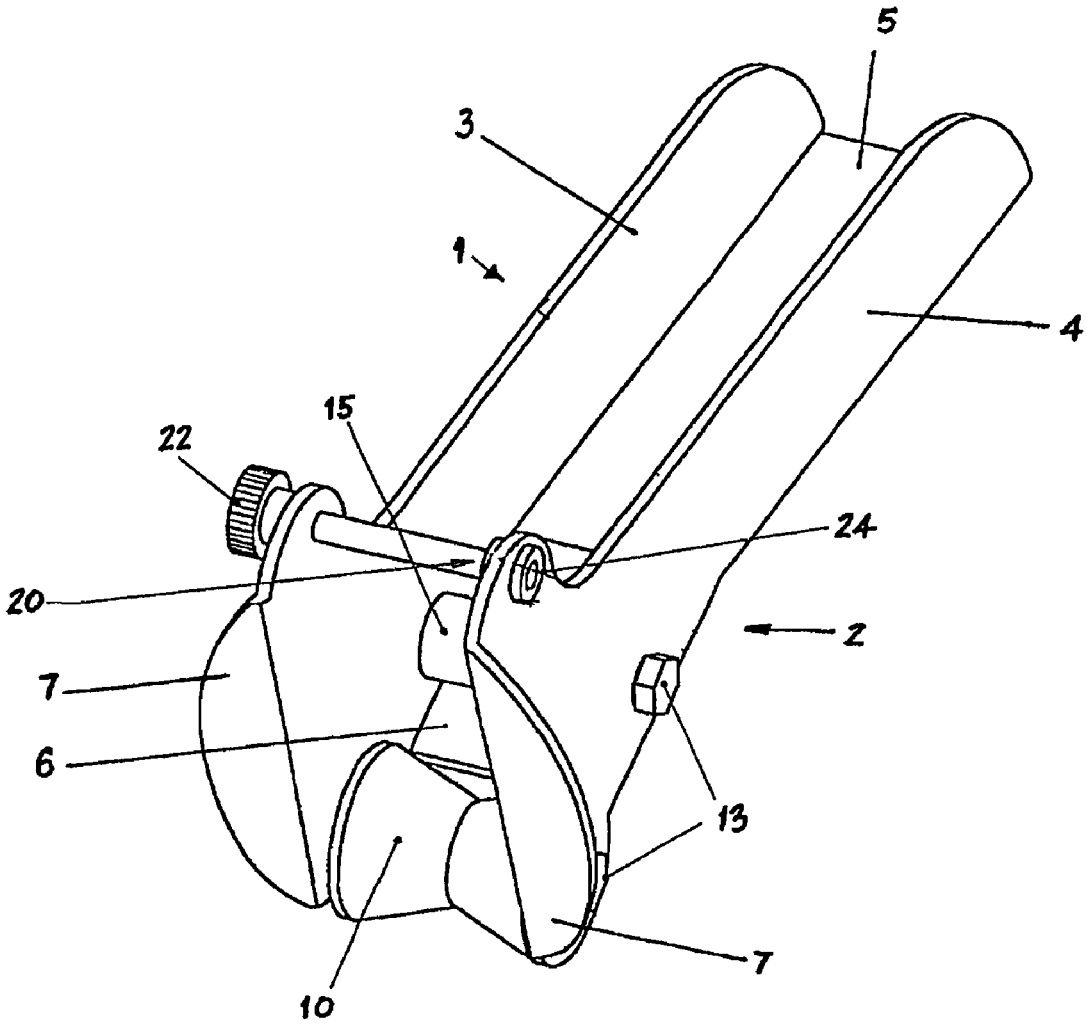
FIG. 1 is a top perspective view of a first embodiment of a bowsprit or davit in accordance with the invention.
Figure 2:
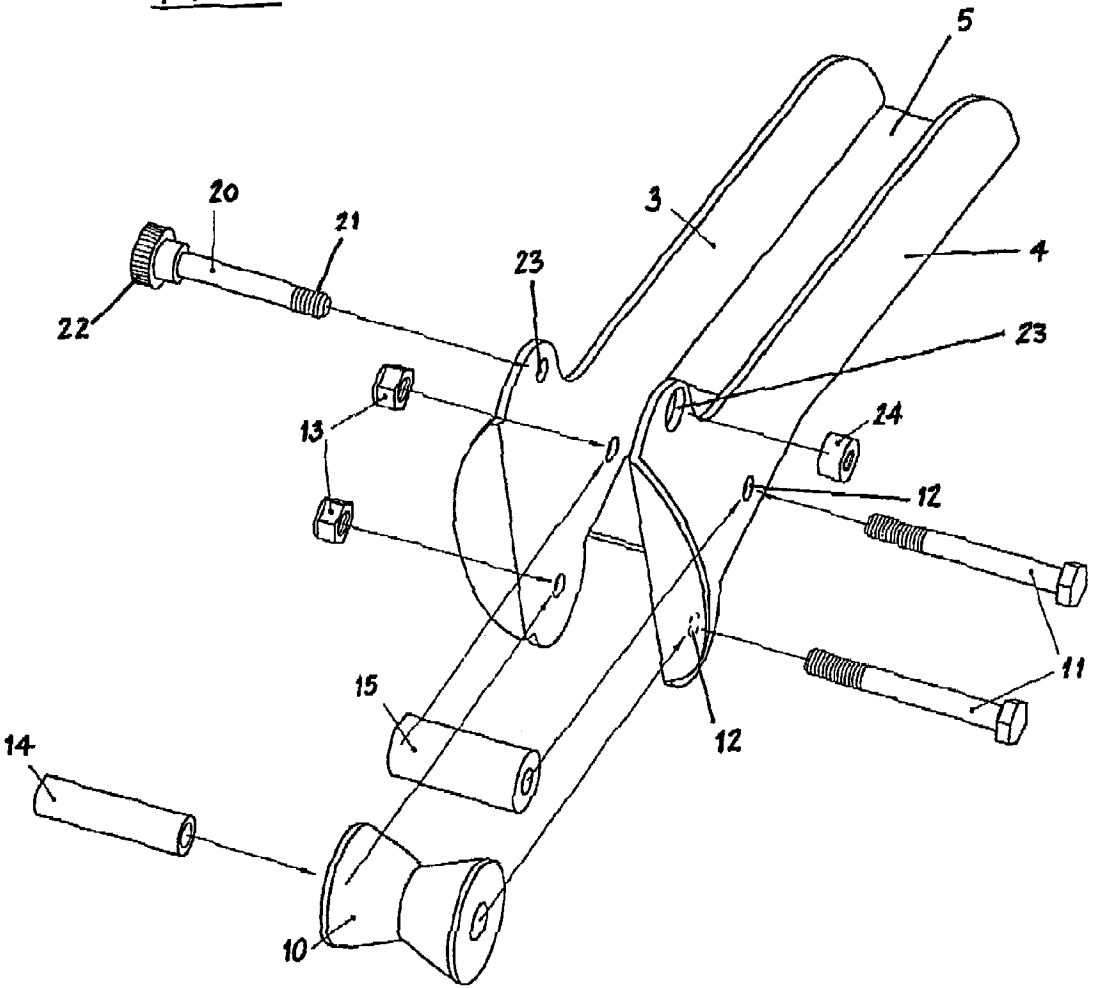
FIG. 2 is an exploded view, again in top perspective, of the embodiment of FIG. 1.
Figure 3:
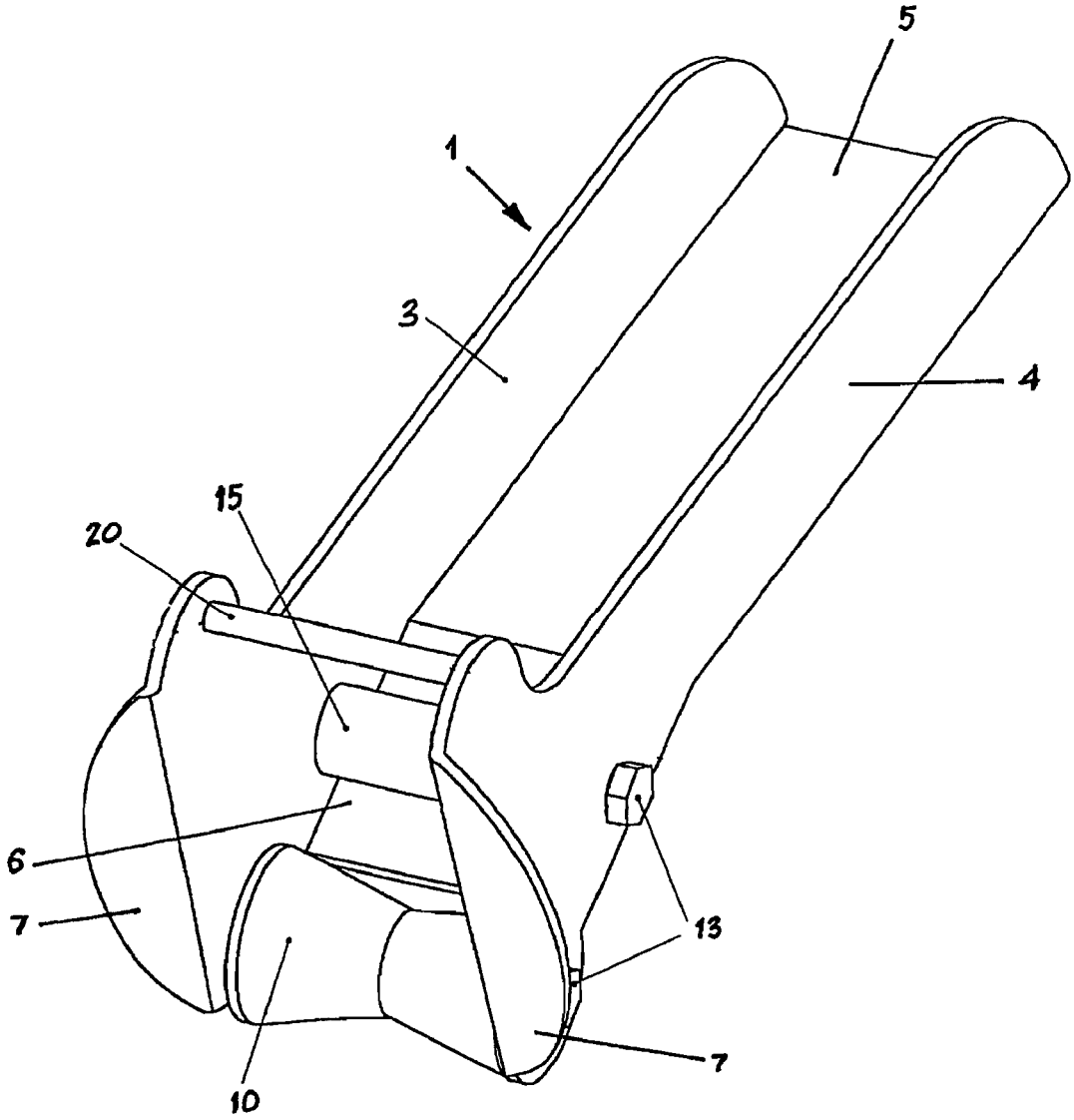
FIG. 3 is a top perspective view of a second embodiment a bowsprit or davit in accordance with the invention.
Figure 4:
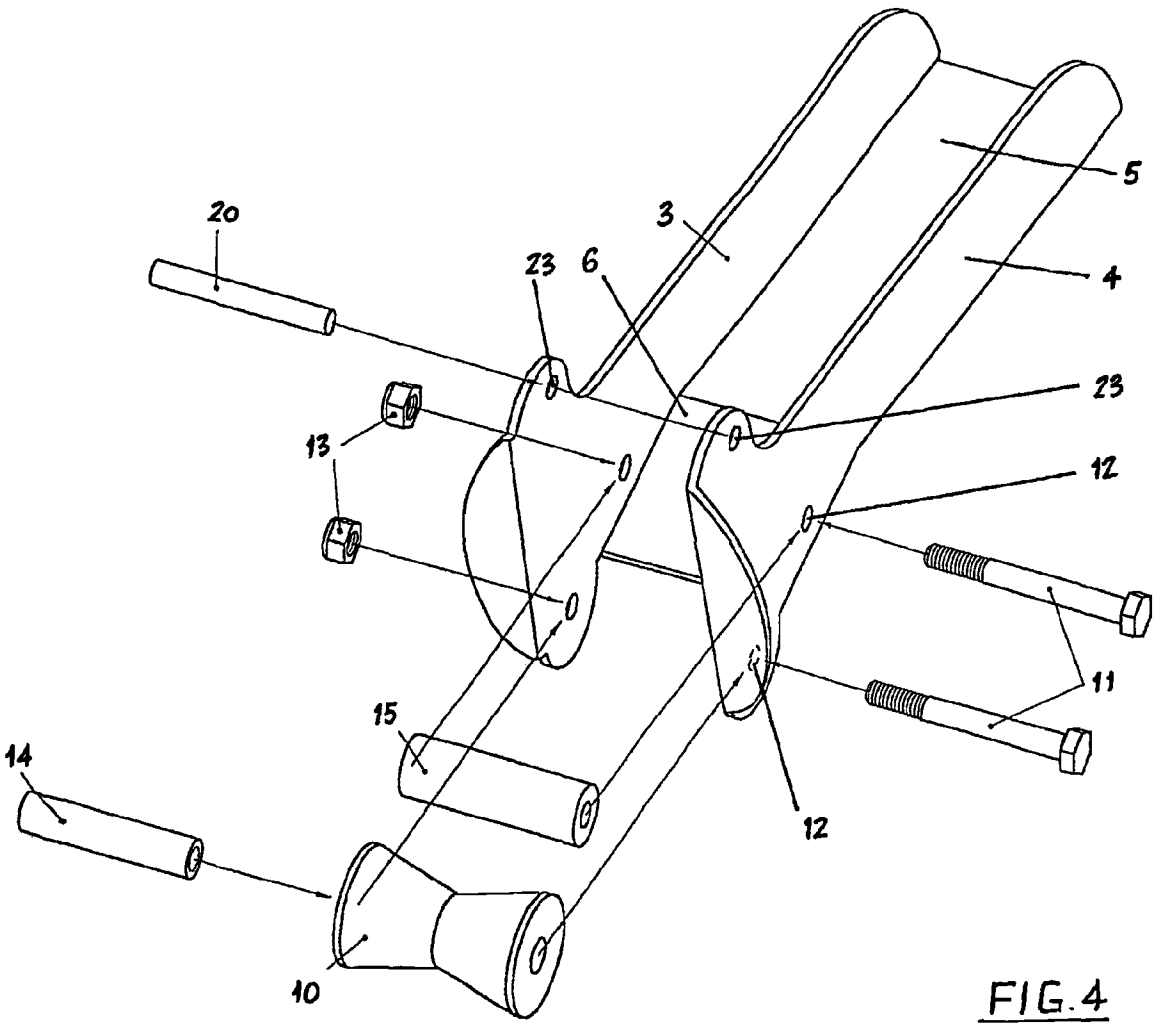
FIG. 4 is a exploded view, again in top respective, of the embodiment of FIG. 3.

A bowsprit or anchor davit is intended to be associated with any given sea-going vessel, to assist in setting and raising of an anchor and also to provide a means for receiving and returning such anchor when that anchor is not in use or set. In that regard anchors as formally in use nowadays include, as their principal components, an elongate shank member and a fluke or the like associated therewith. An anchor line, generally in the form of a length of chain or the like attached in turn to a length of rope (hawser) as attached in any suitable manner to the anchor itself. That anchor line is disposed so as to pass through the bowsprit or davit.

With reference now to the drawings a bowsprit or anchor davit in accordance with the invention includes an elongate, substantially U-shaped frame or main body made up from a first or rear section 1, which is adapted to be preferably releasably affixed (in any known manner) to the deck of a vessel, and a second or front section 2 which is adapted to extend over the edge of a structural member—as for example a deck or the like surface—of a vessel on which the overall bowsprit or davit is to be mounted. The U-shaped frame is made up from opposed side wall members 3 and 4 extending longitudinally of the bowsprit from front to rear thereof, and a substantially flat bottom or base 5, 6 extending therebetween. Preferably the overall bowsprit is a unitary member, constructed from a material of a suitable strength, as for example steel or the like. The base 6 of the front section 2, however, preferably depends at an acute angle downwardly from the base 5 of the rear section 1. The overall bowsprit frame may be releasably attached to the deck or the like surface of the vessel in any suitable manner and using any suitable means, as for example one or more bolts and associated locknuts. To that end the base or bottom 5 of the rear section 1 may be provided, at or in the vicinity of the rear section of the overall frame, with one or more pre-drilled or pre-formed apertures (not shown).

As shown in, for example, FIG. 1, the opposed side wall members 3 and 4 are, over the length of the rear section 1, of a lesser height than over the length of the front section 2. In accordance with a preferred aspect of the invention the rear section 1 of the bowsprit is of a greater length than the front section 2.

At the end of each side wall member 3 and 4 adjacent the outermost extremity of the front section 2 of the frame there is provided a shaped flap 7 extending substantially normally thereto. These flaps 7 function to assist in feeding in of an anchor rope or chain to the bowsprit, to ensure an acceptable degree of directional control therefore. They also protect the anchor rope or chain from unwanted damage—as for example from chafing, scraping or even severing—since there is thus no sharp surface or knife edge to be engaged thereby. This is in marked contrast to known and currently in use arrangements, wherein the front edge of side members of a bowsprit constitute an effective knife edge or cutting surface.

At or in the vicinity of the outermost free end of the front section 2 there is provided a first or primary guide roller 10, extending laterally of the front section 2 and preferably mounted for rotation between the side members 3 and 4 thereof. In the preferred embodiment illustrated the centre-line or rotational axis of the primary roller 10 is disposed below the base of the rear section 1. This primary roller 10 is intended to receive and guide an anchor rope and/or chain, during the operation of raising or setting the anchor.

A variety of different methods and means may be provided for mounting the roller 10 between the side members 3 and 4 of the front section 2. By way of example only, in the embodiment illustrated a bolt or the like means 11 (preferably of the standard hexagonal head type) may be disposed laterally of the front section 2, such to be located in opposed apertures 12 extending through the opposed sides 3 and 4. A locknut or the like means 13 can be employed to fix such bolt 11 in place transversely of the front section 2. A support bushing or spacer tube 14 may be disposed on the bolt I1, thereby to allow for rotation of the roller 10 as disposed thereon. Preferably the roller 10 will be of a substantial V-shape, having a groove formed centrally thereof. In an alternative embodiment (not shown) the outer surface of the roller 10 may have a plurality of grooves formed therein, whereby to enhance engagement of the anchor rope or chain thereby. The roller or pulley wheel 10 itself can be formed from any suitable material, preferably a high strength plastics material.

Within the front section 2, and disposed rearwardly of the shaped primary roller 10 and displaced upwardly therefrom, is a secondary roller 15, in the preferred embodiments illustrated in the form of a straight roller of a suitable high strength plastics material. As with the primary roller 10, this secondary roller 15 is mounted for rotation on a bolt or the like means 11, preferably with the interposition of a bushing or spacer tube 14, with the bolt 11 and associated bushing 14 and secondary roller 15 being releasably affixed transversely of the front section 2, by means of a locknut 13.

At or in the vicinity of the uppermost top end of each side wall member 3 and 4 of the front section 2 there is provided a means adapted to releasably extend therebetween, thereby to maintain those uppermost ends a fixed distance apart from one another, and also to allow for releasing of the anchor line or chain as and if desired. In the preferred embodiment illustrated an elongate member 20 is provided, preferably threaded at one end 21 thereof and having means 22 at the other end thereof to facilitate handling/turning, such elongate member 20 being adapted, in use, to extend transversely of the front section 2 and to extend through complementary shaped apertures 23 provided in the sides thereof. A locknut or the like 24 may be employed to secure this elongate member 20 in place, against unwanted release through the effects of vibration. The means for handling 22 can be in the form of a shaped and knurled end section which, in use, is disposed externally of the front section 2. The elongate member 20 preferably has at least one protrusion thereon, hereinafter termed a roll or tie pin, extending substantially normally therefrom, such serving to prevent unwanted separation of the elongate member or support bolt 20 from the overall assembly.

In an alternative embodiment, not shown, an annular sleeve or the like may be provided on the internal surface of one side wall member of the bowsprit, at or in the vicinity of the uppermost edge thereof, said sleeve or the like being adapted to receive, and releasably retain, the threaded end of the elongate member 20.

The secondary roller 15 is mounted or positioned so as to have its axis substantially in line with the base of the rear section 1. This is in contrast to known and previously in use arrangements, wherein a single roller was mounted at a location relatively above the base of the rear section, a configuration which has been formed to give rise to undue stresses on means employed for actually mounting the overall bowsprit to the deck. These stresses have been known to result in undesirable and unwanted bending of the overall bowsprit. With the present arrangement, in effect all forces are kept substantially parallel with the mounting screws or means, minimising any possible levering effect due to off-set loading.

The first or primary roller 10 is disposed well forward of the junction of the respective front and rear sections 2 and 1. In the result the rope or chain is extremely unlikely to come into contact with any metal edge, further reducing the likelihood of damage thereto (as by chafing, scraping or even cutting).

The hand-operated, releasable, solid screw-in bolt 20 extending across the upper ends of the side members 3 and 4 of the front section affords increased rigidity and strength to the bowsprit when installed. Such an arrangement is substantially proof against unwanted release or relaxation, as could occur with vibration in known arrangements. Furthermore, it ensures that the rope or chain cannot work free of the overall bowsprit during retrieval of an anchor, as can be possible with known arrangements.

The arrangement is such that, when the anchor is not in use, the shank portion thereof is located within the U-shaped main body, with the fluke or leading end thereof located at or in the vicinity of the outermost free end of the second or front section 2. The anchor cable or line can then be tied off internally of the vessel in any suitable manner, whereby to retain the overall anchor in place relative to the bowsprit. When it is time for the vessel to be moored or anchored, then the anchor cable/line is released and the anchor allowed to fall free from the bowsprit, to be deployed as necessary. When it is time to retrieve the anchor, then it is released from its footing and brought back into its storage location, within the bowsprit. The present arrangement, by its very configuration, generally facilitates there procedures.

The present applicant's arrangement of bolt or the like 11 and associated bushing or spacer tube 14 for mounting of the rollers 10, 15 affords increased strength and rigidity. With the primary roller 10, for example, a heavy duty (metal) sleeve or bushing 14 is employed. As the bolt or the like 11 is tightened, the ends of this sleeve or bushing 14 come into contact with the internal surfaces of the side members 3, 4 of the bowsprit. The end result is an extremely rigid and significantly stronger unit.

With the present applicant's arrangement, in the instance of undue wear of either of the rollers 10, 15, or other damage thereto, they can each or selectively be readily replaced, or removed for repair. This is again in contrast to presently known and in use arrangements, wherein removal of the single roller for repair and/or replacement can be quite a difficult and time-consuming task.

By virtue of the fact that the respective rollers 10, 15 are arranged spaced apart, both longitudinally and in a height direction within the overall bowsprit, then the moment the anchor shank enters the primary roller 10 the anchor fluke is drawn forwardly, in other words way from the bow of the vessel. This removes the possibility of the anchor, during retrieval, itself causing damage to the hull of the vessel.

The arrangement in accordance with the present invention is responsible for a number of practical advantages, when compared with the prior art, as explained hereinafter.

Firstly, and because of its size and configuration, it is suitable for use with in effect any type and size of anchor now available. The overall dimensions are such as to allow it to cater for, receive or house virtually any anchor. No currently available bowsprit has this flexibility of use.

Secondly it effectively guarantees that the anchor, as it is being drawn up, is righted and in the correct disposition to be properly housed and locked away, regardless of how the anchor is originally disposed when released from its setting.

The use of primary and secondary rollers prevents scuffing or damaging of the anchor rope, and also allows an anchor to free fall without any possibility of jamming.

By being of a substantially integral or unitary construction, the overall bowsprit is stronger and less prone to unwanted bending or flexing under load, when compared with the prior art arrangement.

The arrangement is such that the rope or chain cannot escape from the confines of the bowsprit during retrieval of an anchor, hence minimising the likelihood of injury to the unwary or careless user.

It is to be understood that the dimensions of the bowsprit of the present invention may be varied to suit the mounting conditions, the size of the anchors to be accommodated and other factors.

It is also to be understood that the present invention is not limited to the structure precisely as illustrated. Thus, by way of example and not of limitation, the pulley wheel(s) could be mounted on a pair of pivoting arms to move in much the same direction, or could be mounted in a track; the entire assembly could be mounted at a different angle, for example, on a block of wood, instead of horizontal on the deck, and the anchor cable could take the form of a nylon rope or line, a wire rope, or an old-fashioned rope hawser, instead of a chain; suitable resilient elements or bumpers could also be employed in the structure.

Also, the assembly could be used to raise and lower, and to store, anchors of irregular configurations.

Finally it should be understood that the aforegoing description refers merely to preferred embodiments of the invention, with variations and modifications being possible thereto without departing from the spirit and scope of the invention, the ambit of which is to be determined from the following claims.

The invention claimed is:

1. A bowsprit assembly for raising and lowering an anchor from a vessel surface, the anchor having a main shank coupled to a rope, the assembly comprising:

an elongated U-shaped frame member having an aft end arranged to receive and releasably retain the main shank of the anchor when the anchor is not deployed and a forward end rigidly connected to the aft end and depending downwardly therefrom at an acute angle;

the frame member having a base member that is generally horizontal in use and a pair of upwardly extending sidewalls spaced normal to the direction of elongation of the frame member, the sidewalls having upper free edges and lower edges that are joined to the base member along a portion of the length of the sidewalls;

the frame member forming an anchor rode path extending in the direction of elongation of the frame member that is above the base member and between the sidewalls and extending from the forward end to the aft end;

a first roller rotatably mounted between the sidewalls and adjacent the lower edges of the sidewalls to lie immediately beneath and adjacent to the path at the forward end of the frame member; and a second roller aft of the first roller along the path, the second roller being rotatably mounted between the sidewalls and adjacent to the lower edges of the sidewalls to lie immediately beneath and adjacent to the path formed in the frame member;

means for maintaining the spacing between the sidewalls at the forward end;

wherein the means for maintaining the spacing between the sidewalls comprises an elongate member extending between the sidewalls;

wherein the elongate member extends through an aperture in one sidewall and has an end that is releasably affixed to the other sidewall;

wherein the elongate member is threaded at the end that is releasably affixed to the other sidewall; and a locknut located within a complementary-shaped aperture provided in the other sidewall and releasably engaging the threaded end of the elongate member.

2. The assembly of claim 1, wherein the end of the elongate member comprises a knurled handle.

3. The assembly of claim 1, wherein the aft end is adapted to be releasably attached to the vessel surface.

4. The assembly of claim 3, wherein the base member is adapted to be releasably attached to the vessel surface.

5. The assembly of claim 1, wherein each sidewall comprises a flange extending outwardly at the forward end.

6. The assembly of claim 1, wherein each roller is mounted on a bushing, the bushing being mounted on an elongate member extending transversely of the sidewalls.

7. The assembly of claim 1, wherein the rollers are constructed from a high-strength plastics material.

8. The assembly of claim 1, wherein the first roller comprises at least one groove.

* * * * *